US005125266A

United States Patent [19]

Ingram et al.

[11] Patent Number: 5,125,266

[45] Date of Patent: Jun. 30, 1992

[54] SELF-CONTAINED APPARATUS AND METHOD FOR DETERMINING THE STATIC AND DYNAMIC LOADING CHARACTERISTICS OF A SOIL BED

[75] Inventors: Wayne B. Ingram, Kingwood; Byron W. Porter, Houston, both of Tex.

[73] Assignee: Fugro-McClelland Leasing, Inc., Houston, Tex.

[21] Appl. No.: 745,730

[22] Filed: Aug. 16, 1991

Related U.S. Application Data

[62] Division of Ser. No. 500,148, Mar. 27, 1990, abandoned.

[51] Int. Cl.[5] ..... G01N 19/02

[52] U.S. Cl. ..... 73/84; 73/155; 73/864.45

[58] Field of Search ..... 73/84, 155, 864.45; 166/338

[56] References Cited

U.S. PATENT DOCUMENTS

| | | | |
|---|---|---|---|
| 2,701,121 | 2/1955 | Bull | 255/1.4 |
| 2,833,120 | 5/1958 | Barrett et al. | 61/73 |
| 3,163,241 | 12/1964 | Daigle et al. | 175/237 |
| 3,481,188 | 12/1969 | Mori | 73/84 |
| 3,500,678 | 3/1970 | Van Romondt Vis | 73/84 |
| 3,875,796 | 4/1975 | Gilliard | 73/170 |
| 3,916,684 | 11/1975 | Rundell | 73/151.1 |
| 4,085,509 | 4/1978 | Bell et al. | 33/134 R |
| 4,400,970 | 8/1983 | Ali | 73/9 |
| 4,419,886 | 12/1983 | Peterson | 73/151.5 |
| 4,499,955 | 2/1985 | Campbell et al. | 175/46 |
| 4,499,956 | 2/1985 | Campbell et al. | 175/46 |
| 4,530,236 | 6/1985 | van den Berg | 73/84 |
| 4,544,819 | 11/1985 | Ali | 73/9 |
| 4,601,354 | 7/1986 | Campbell et al. | 175/46 |
| 4,638,872 | 1/1987 | Park et al. | 175/46 |
| 4,770,030 | 9/1988 | Smith | 73/864.45 |

FOREIGN PATENT DOCUMENTS

| | | |
|---|---|---|
| 0083141 | 7/1983 | European Pat. Off. . |
| 7906280 | 8/1979 | Netherlands . |
| 331148 | 8/1958 | Switzerland . |
| 466154 | 1/1969 | Switzerland . |
| 1433265 | 4/1976 | United Kingdom . |

OTHER PUBLICATIONS

M. J. Hvorslev, "Subsurface Exploration and Sampling of Soils for Civil Engineering Purposes", pp. 121-122 (Nov. 1949).

Fugro brochure, "Electronic Cone Penetrometer".

McClelland Engineers brochure, "Stingray Cone Penetrometer System for Marine Geotechnical Investigations".

*Primary Examiner*—Hezron E. Williams
*Assistant Examiner*—Craig Miller
*Attorney, Agent, or Firm*—Arnold, White & Durkee

[57] ABSTRACT

The invention comprises an improved self-contained, environmentally isolated, multi-parametric measuring apparatus and method for sampling and determining the dynamic loading characteristics of a soil bed. The apparatus is specially adapted to withstand the extreme pressures of deep water applications. In operation, a drill string presses the apparatus of the invention into a soil bed at an uncontrolled rate resulting in a variable penetration rate. The apparatus has a self-contained data acquisition system that measures and records, as a function of time, the force exerted on the sampling apparatus and the depth of penetration as the drill string presses the sampling apparatus into the soil bed.

Data is provided that enables the user to determine the static soil characteristics (e.g., shear strength and stress-strain characteristics) and the dynamic loading characteristics of the soil bed. The apparatus captures a sample of the soil for laboratory analysis. The data collected provides information on the quality of the sample and location of defects in the sample which would affect laboratory test results. The apparatus is self-contained and operates independently of surface telemetry. The method of the invention may be performed in less time than known systems and can be advantageously performed from a floating platform, because the apparatus of the invention is self-compensating and not adversely affected by variable sea states.

10 Claims, 7 Drawing Sheets

FIG.4
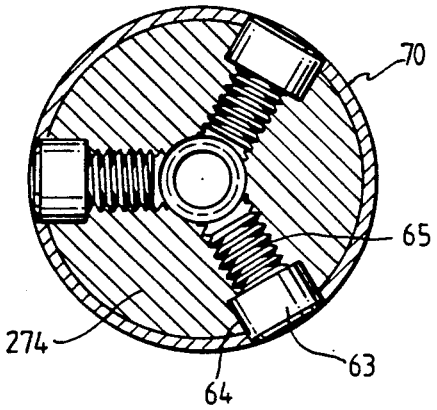
FIG.6
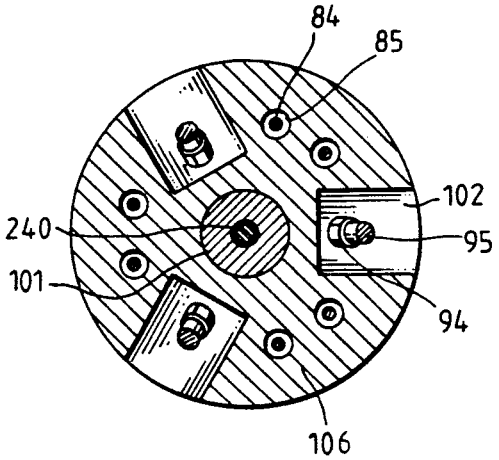
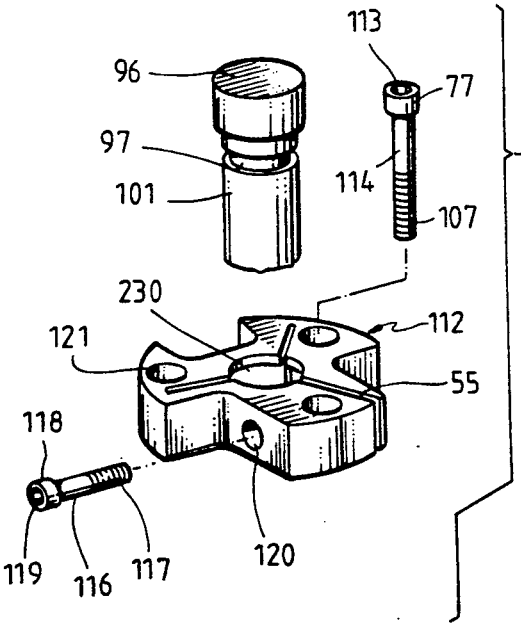
FIG.5
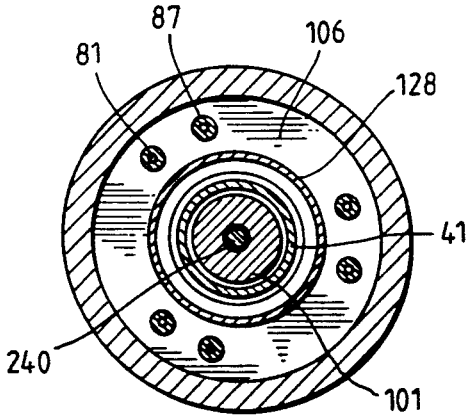
FIG.7

FIG.8
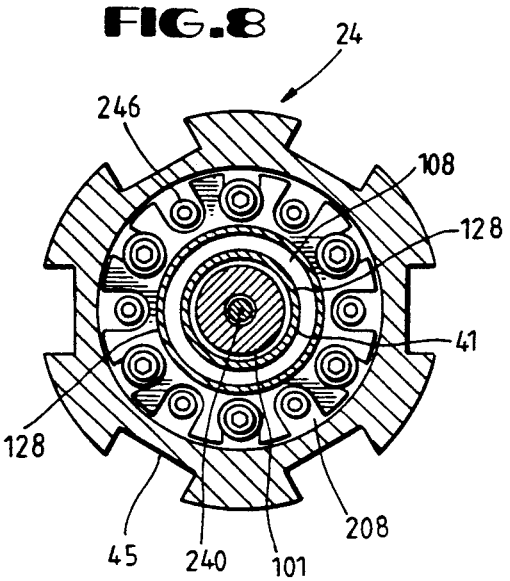
FIG.10
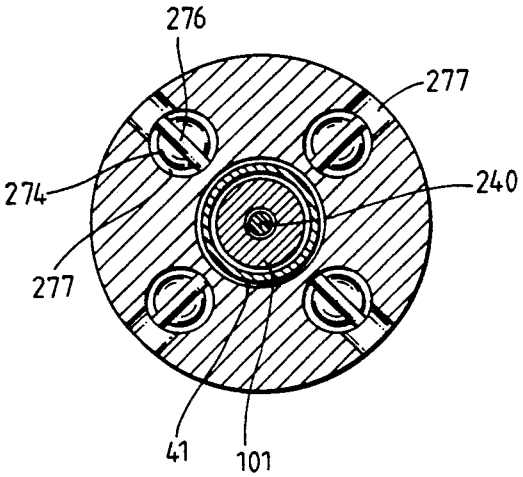
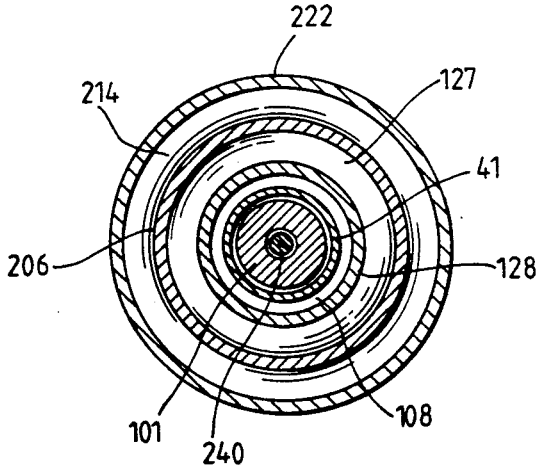
FIG.9
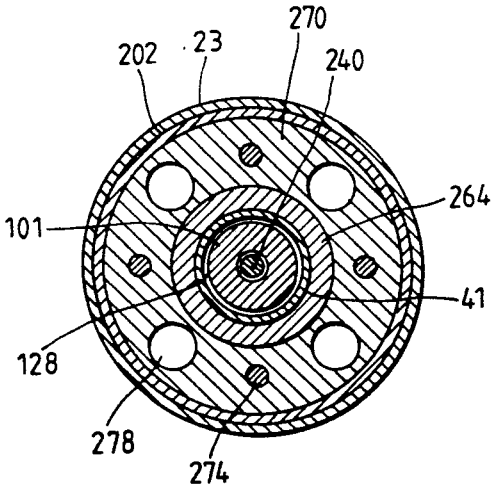
FIG.11

SELF-CONTAINED APPARATUS AND METHOD FOR DETERMINING THE STATIC AND DYNAMIC LOADING CHARACTERISTICS OF A SOIL BED

This application is a divisional of Ser. No. 07/500,148 filed Mar. 27, 1990, now abandoned.

BACKGROUND OF THE INVENTION

This invention relates generally to novel data gathering and sampling in connection with soil mechanics. More particularly, this invention concerns a method and apparatus for sampling and determining the dynamic loading characteristics of a soil bed, and more particularly, a method for measuring, as a function of time, the force and displacement on a soil sample as the apparatus presses into a soil bed at an uncontrolled rate resulting in a variable penetration rate. The apparatus may be used in connection with a sub-sea soil bed or a soil bed on land.

In the past, it has been common practice to extract soil samples and make laboratory measurements of data concerning the characteristics of a soil bed on the recovered samples. While some arrangements have exhibited at least a degree of utility in the gathering of data in connection with soil mechanics analysis, room for significant improvement remains.

The structural loading of soil has been a problem for many years, but these problems were not approached in an orderly manner until the advent of modern soil mechanics theory in the 1920's. The application of soil mechanics theory requires the collection of accurate data to evaluate certain soil parameters. The task of gathering reliable data is of paramount importance in the satisfactory application of soil mechanics theory. This task becomes acutely more difficult when analyzing a soil bed that lies beneath a body of water.

As the world's oil supply dwindles and available land based drilling sites are exhausted, the need to construct offshore oil drilling platforms increases. The increased size and utilization of these offshore platforms magnifies the need for reliable data to evaluate the stability of sub-sea soil beds. Offshore platforms constructed on pilings driven into the soil bed under bodies of water proliferate in the Gulf of Mexico and along the continental shelf bordering the east and west coasts of the United States.

Data taken while sampling a soil bed helps determine the soil bed's ability to support the foundation of a structure. A foundation is only as stable as the soil bed that supports it. Accurate data collection concerning a soil bed is the first step in correctly evaluating the soil bed's ability to support a structural foundation. A stable foundation is fundamental to the stability of a structure. The need for accurate design data is paramount. A calculation based on erroneous data is a miscalculation that can produce disastrous results. A structure built upon a piling foundation, subjected to a sudden load from a wave surge or earthquake, can collapse, resulting in a loss of life and property.

The ability of a soil bed to support a structure's foundation is related to the rate a load is applied to the foundation. While a soil bed may adequately support a foundation during normal wave activity, or normal land based loading, the soil bed may not adequately support the foundation during a sudden surge in response to severe wave action or an earthquake. An unexpected load applied suddenly to the foundation could topple the structure. Therefore, there is an important need to accurately predict the ability of a soil bed to support a structure, especially during the variable rate loading conditions experienced on land and at sea. Variable rate loading characteristics are referred to as the dynamic loading characteristics of the soil bed.

Present methods and apparatus for measuring the ability of a soil bed to support a structure are limited in several ways. First, there are no known methods or apparatus that measure the dynamic loading characteristics of a soil bed as a function of time. Moreover, present methods and apparatus utilize short displacement, cyclic, linear penetration techniques that penetrate a soil bed at a constant rate and do not measure the dynamic loading characteristics of the soil.

Known measuring systems are intolerant of a hostile sea state and require a benign sea state to obtain accurate data. Unless these methods and apparatus are used in smooth water conditions, motion compensation devices must be used to obtain accurate measurements.

Physical interface umbilicals from the surface are difficult to deploy and present a formidable, if not impossible, design challenge in deep sea applications. In addition the tremendous pressure exerted on equipment and instrumentation submerged in over five hundred fathoms of water presents a formidable design problem.

Isolating a monitoring system from extreme water pressure and from the corrosive action of the sub-sea environment is extremely difficult. These problems are exacerbated by the use of physical umbilicals.

The problems enumerated in the forgoing are not exhaustive but rather are among many which tend to impair the effectiveness of previously known soil sampling and data gathering systems. Other noteworthy problems may also exist; however, those presented above should be sufficient to demonstrate that soil sampling and data gathering systems appearing in the art have not been altogether satisfactory.

OBJECTS OF THE INVENTION

Recognizing the need for an improved soil sampling and data gathering system it is, therefore, a general object to provide a novel method and apparatus for determining the dynamic loading characteristics of a soil bed which are simple to construct and operate and which obviate the need for an umbilical between the apparatus and the surface.

Another object of the present invention is to provide a self-contained method and apparatus for determining dynamic loading characteristics of a soil bed by measuring a plurality of parameters associated therewith.

Yet another object of the present invention is to provide a method and apparatus for determining the dynamic loading characteristics of a soil bed, that can withstand the extreme pressures of deep water operations without leakage and remain isolated to neither contaminate nor be contaminated by the ocean environment.

A further object of the present invention is to provide a self-compensating method and apparatus for determining the dynamic loading characteristics of a under water soil bed that can be operated from a floating platform.

To attain these and other objectives, an apparatus for sampling a soil bed from the surface of the earth or the surface of a body of water is provided. The apparatus includes a housing adapted to attached to the bottom of a drill string. On land the housing may be attached directly to the drill string by removing the drill string from the well bore and attaching the housing to the bottom of the drill string in place of the drill bit. At sea the housing may be dropped down the drill string or lowered from a wire line within the drill string for transporting the apparatus from the surface of a body of water to a location adjacent the soil bed beneath the body of water. Additionally the apparatus includes a sub positioned in the drill string and adapted to receive the apparatus housing during sea-based operations, a sample tube extending below the housing for penetrating the soil bed, a means for attaching the housing to the bottom of the drill string, a selectively lockable means for use during sea-based operations to selectively lock the housing into the sub to enable the housing to transmit load between the drill string and the sample tube, a load detector within the housing adapted to generate a first signal corresponding to loading as a function of time on the sample tube, a movement detector within the housing adapted to generate a second signal corresponding to the upward displacement of a soil sample within the sample tube and a recorder within the housing adapted to record the first and second signals simultaneously.

Examples of the more important features of this invention have thus been summarized rather broadly in order that the detailed description thereof that follows may be better understood, and in order that the contribution to the art may be better appreciated. There are, of course, additional features of the invention that will be described hereinafter and which will also form the subject of the claims appended hereto.

Additional objects, features and advantages of the present invention will become apparent with reference to the following detailed description of a preferred embodiment thereof in connection with the accompanying drawings, wherein like reference numerals have been applied to like elements.

SUMMARY OF THE INVENTION

The present invention addresses the problems described above by providing a system for sampling a soil bed which is capable of operation from a floating or land-based platform. The system is further capable of pressing on a soil bed at a uncontrolled rate resulting in a variable penetration rate, and also retrieving a soil sample. The variable penetration rate is beneficial in providing insight into the dynamic loading characteristics of the soil bed.

The apparatus of the invention is self-contained. It may be attached directly to the bottom of a drill string or it may be dropped down the well bore or lowered on a wire line without removing the drilling apparatus. Consequently, samples may be obtained and retrieved from, say, a well bore without removing drilling apparatus from the bore. An instrument package may be deployed and retrieved from a well bore without removing drilling apparatus from the bore. The apparatus contains a data acquisition system that records various parameters, notably the soil penetration rate and the load required to affect penetration. Soil samples captured by the apparatus are retrievable raising the drill string or retrieving the housing by wire line, thus enabling the operator to keep the drilling apparatus in the well bore throughout the sampling.

The system of the invention is suitable for use with conventional drilling systems. The apparatus of the invention is insertable into a conventional drill string above a conventional drag bit or coring bit, i.e., a bit having a central passageway or opening. The apparatus of the invention may also be attached directly to the bottom of a drill string.

The apparatus of the invention also comprises an elongated housing, adapted at its upper end to releasably engage an overshot or the like for attachment to the lower end of a wire line. A plurality of dogs or the like are positioned near the upper end of the housing. The dogs engage recesses formed in the inner wall of the housing, and are designed to be retractable.

A sample tube, preferably cylindrical in shape, comprises or attaches to the lower end of the housing. The sample tube slides through the opening in the drill bit when the housing is locked into the drill line during sea-based operation. When the apparatus of the invention locks into position in the sub for sea-based operation, the sample tube protrudes below the bit by a selected amount, which in practice may measure about two feet or about sixty centimeters. Thus, as the sample tube presses into a soil bed, a sample of the soil enters the sample tube.

The housing portion of the apparatus generally will be an assembly of several components. A first such component, a load cell, positioned in the housing, couples to the top of the sample tube. The load cell measures the axial load imposed on the sample tube. There are many ways to measure such a load.

A second component of the housing is an instrument chamber or compartment. This component will normally contain a power pack, a data acquisition system and an electronics package. The instrument compartment may also contain an LVDT unit or other position measuring device for indicating the extent to which a core sample enters the sample tube. To activate the LVDT unit, a sample or core follower is preferably provided within the sample chamber. The core follower includes a piston immediately above a sample in the sample tube and a piston rod attached to the piston. As a soil sample enters the sample tube, the piston travels upward. The LVDT core rod attaches to the piston to provide a measurement of the sample length.

From these features of the invention, it becomes apparent that use of the invention provides a continuous record of the load acting to penetrate and withdraw a soil bed, as well as the extent of penetration. The invention also provides a soil sample which is retrievable from the surface of a body of water or from the surface of the earth.

An especially attractive feature of the invention is its ability to operate without motion compensation. Thus, movement of a floating vessel or platform from which the invention operates may vary the loading on the sample tube as well as its rate of penetration without degradation of the measurement data's accuracy. However, these are the same type of dynamic factors which affect the legs of platforms, pilings or other structural members which penetrate a soil bed. Hence, the dynamic data provided by the present invention provides a very useful insight into the dynamic performance to be expected of such structural members in a soil bed from which the data is obtained.

In accordance with the invention, the load data and the penetration data for a given soil sample are recorded with time as the sample tube presses into the soil. The resulting records are especially valuable in reflecting the uniformity of the soil.

The invention has particular application not only in offshore operations, but is also of great interest in land based operations. In addition to oil and gas drilling structures, the invention is useful in other offshore and land based structures such as, for example, bridges, towers, tall buildings, and the like. The dynamic characteristics are useful in the evaluation of soil properties for earthquake analysis.

In one aspect of the present invention, a method is provided for determining the dynamic loading characteristics of a soil bed by measuring the forces exerted on a self-contained, environmentally isolated data measurement and sampling apparatus. A sample tube presses into the soil bed at an uncontrolled rate resulting in a variable penetration rate. The data acquisition system measures and records the force, as a function of time, exerted on the sample tube during penetration and withdrawal. The data acquisition system measures and records the depth of penetration as a function of time. These measurements are used to determine the dynamic loading characteristics of the soil bed. The method includes a step whereby the sample tube captures a soil sample for laboratory analysis at the surface.

Soil parameters of primary interest are pile design parameters with an emphasis on open ended steel pipe piles which are used offshore. If a steel pipe pile and a steel sample tube are compared, they are of very similar proportions. It is therefore to be expected that the parameters measured while pushing a sampling tube into a soil bed may be applied to driving a pile into the soil. The value of these measurements is accordingly apparent. With appropriate interpretation and modification, the measurements taken during sampling may be applied advantageously to pile design.

BRIEF DESCRIPTION OF THE DRAWINGS

FIG. 4 is a view taken along section lines 4—4 of FIG. 3A.

FIG. 5 is an exploded view of a retaining clamp to hold the LVDT in place and to prevent the LVDT from being pushed into the instrument compartment by extreme water pressures at great depths under water.

FIG. 6 is a view taken along section lines 6—6 of FIG. 3B.

FIG. 7 is a view taken along section lines 7—7 of FIG. 3C.

FIG. 8 is a view taken along section lines 8—8 of FIG. 3C.

FIG. 9 is a view taken along section lines 9—9 of FIG. 3C and shows the load cell web. All the load is transmitted through the load cell web. The outer sleeve of the load cell and the inner sleeve of the load cell are shown along with the piston sleeve, the LVDT and the LVDT core rod.

FIG. 10 is a view taken along section lines 10—10 of FIG. 3D and shows a fluid release orifice positioned at the top of each ball valve channel. The piston sleeve, the LVDT and the LVDT core rod are shown concentrically located in the apparatus housing.

FIG. 11 is a view taken along section lines 11—11 of FIG. 3D and shows the piston sleeve bearing secured to the piston sleeve bearing retainer.

Figure 1A:
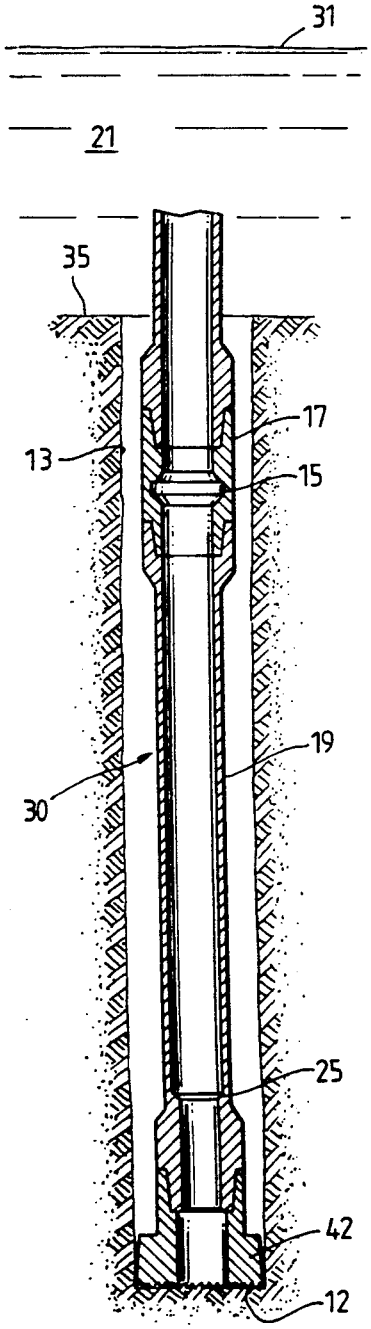
FIG. 1A is a schematic or conceptual drawing that shows a boring drilled to the desired depth in a soil bed using an open ended drag bit.

While the invention is susceptible to various modifications and alternative forms, specific embodiments thereof have been shown by way of example in the drawings and are herein described in detail. It should be understood, however, that it is not intended to limit the invention to the particular forms disclosed. On the contrary, the intention is to cover all modifications, equivalents, and alternatives falling within the spirit and scope of the invention as defined by the appended claims.

DETAILED DESCRIPTION

This detailed discussion of the apparatus of the invention is not intended to be exhaustive. It is readily envisioned that the apparatus may embody various types and styles of each element without departing from the spirit and scope of the invention.

GENERAL SUMMARY

FIGS. 1A-1F and FIGS. 3A-3D show an apparatus for sampling from the surface of land or a body of water a soil bed at the bottom of a bore hole in the presence of a drill string constructed according to a preferred embodiment of the invention. The apparatus may be seen to comprise seven main subassemblies; namely a housing assembly 14 adapted to be dropped down a drill string or lowered by a wire line within the drill string and utilized for transporting the apparatus of the invention from the surface 31 of land or of a body of water 21 to a location adjacent the soil bed, a drill string latching sub assembly 17 positioned in the drill string adapted to receive the housing assembly, a sample tube assembly 23 extending below the bottom of the drill string 30 and beyond the drill bit 42 for penetrating and sampling the soil bed, selectively lockable means 20 to lock the housing into the drill string latching sub assembly 17 to enable the drill string 30 to apply an axial load to the housing assembly 14 through the load detector assembly 9 to the sample tube assembly 23, a load detector assembly 9 within the housing assembly 14 adapted to generate a first signal corresponding to loading as a function of time on the sample tube assembly 23, a movement detector assembly 16 within the housing assembly 14 adapted to generate a second signal corresponding to the upward displacement of a soil sample within the sample tube and a recorder assembly 18 within the housing assembly 14 adapted to record said first and second signals simultaneously.

THE HOUSING ASSEMBLY

The housing assembly 14 of the present invention is utilized to contain the load detector assembly 9, the movement detector assembly 16, the sample tube 23, the recorder assembly 18 and the selectively lockable means 20 down the well bore 13 and through the drill string 30 without removing the drill string 30 from the well bore 13. The operator drops the housing assembly 14 down the drill string 30 or lowers the housing assembly 14 down through the drill string 30 using a wire line 28 attached to an over shot assembly 29. The over shot assembly attaches to overshot adaptor 22 at the top of the housing assembly 14. The operator lowers the apparatus of the invention through the drill string 30 to a location adjacent the bottom 12 of the well bore 13 drilled into a soil bed 35.

The drill string 30 may contain a latching sub assembly 17. The latch-in assembly 34 contains the selectively lockable means 20. The selectively lockable means locks into the drill string latching sub assembly 17 locking the housing assembly 14 into the drill string 30. The latch-in assembly 34 is secured to the adaptor for the latch-in assembly 62 by threads 60 formed on the latch-in assembly adaptor tapered member 26. The threads 60 are formed on tapered member 26 at the top of the latch-in assembly adaptor body 61.

The landing ring 24 attaches to the housing assembly 14. The drill string 30 contains drill string landing sub assembly 19 with an drill string landing ring 25 near the bottom of the drill string 30. The landing ring 24 engages the drill string landing ring 25 positioning the housing assembly 14 in the drill string 30 as the housing assembly 14 is lowered by a wire line 28 or dropped and allowed to free fall into place in the drill string 30. The selectively lockable means 20 engages the drill string latching sub assembly 17 when the landing ring 24 positionally engages the drill string landing ring 25. The landing ring 24 is fluted to allow fluid to pass through the flutes 45.

In land-based operations the operator may drill a well bore 13 using a drill bit 42 and then remove the drill string 30 from the well bore 13. The operator may remove the drill bit 42 and replace it with the housing 14. The housing 14 attaches t the bottom of the drill string 30. The threads 60 on the tapered member 26 engage the threads at the bottom of the drill string 30. The operator may lower the drill string 30 with the attached housing 14 down into the well bore to a position adjacent the soil bed. The drill string then forces the sample tube 23 into the soil bed. The operator removes the drill string 30 to retrieve the housing 14 and the soil sample 50.

The housing assembly 14 includes a plurality of sleeves and annular transition members that form the exterior sheath of the housing assembly. The sleeves and transition members slide over the cylindrical members of the housing assembly. A plurality of cap screws secure the housing assembly sleeves and transition members to the cylindrical members.

The adaptor for the latch-in assembly 62 slides into housing exterior sleeve member 66. One or more cap screws 64 secure housing exterior sleeve member 66 to latch-in assembly adaptor body 61. The aperture 63 enables mechanical engagement and rotation clockwise and counterclockwise of cap screws 64. The cap screw threads 65 engage latch-in assembly adaptor body 61.

The instrument compartment plug 68 slides into the housing exterior sleeve member 66. One or more cap screws 70 secure housing exterior sleeve member 66 to instrument compartment plug 68. The aperture 72 enables mechanical engagement and rotation clockwise and counterclockwise of the cap screws 70. The cap screw threads 73 engage the instrument compartment plug 68.

An o-ring seal forms a water tight seal between the instrument compartment plug 68 and the exterior sleeve member. The o-ring seal includes an o-ring 74, an o-ring groove 76 and an o-ring backing 75. The o-ring 74 fits within the o-ring backing 75. The o-ring backing 75 fits within the o-ring groove 76.

The housing exterior sleeve member 66 attaches to the housing member 106 by engaging threads 302. The aperture 118 enables mechanical engagement for rotation of the housing exterior sleeve member 66 clockwise and counterclockwise. The aperture 54 enables mechanical engagement for rotation of housing member 106 clockwise and counterclockwise.

An o-ring seal forms a water tight seal between the housing exterior sleeve member 66 and the housing member 106. The o-ring seal includes an o-ring 104, an o-ring groove 105 and an o-ring backing 103. The o-ring 104 fits within the o-ring backing 103. The o-ring backing 103 fits within the o-ring groove 105.

The upper housing member 106 slides into the lower housing member 126. The Cap screws 124 secure the housing member 126 to the housing member 106. The apertures 130 enable mechanical engagement and rotation clockwise and counterclockwise of the cap screws 124. The cap screw threads 129 engage the housing member 106.

An o-ring seal forms a water tight seal between the housing member 106 and the housing member 126. The o-ring seal includes an o-ring 122, an o-ring groove 56 and an o-ring backing 123. The o-ring 122 fits within the o-ring backing 123. The o-ring backing 123 fits within the o-ring groove 56.

The housing member 126 attaches to the sleeve member 200 by engaging the threads 212. The aperture 109 enables mechanical engagement for rotation of the housing member 126 clockwise and counterclockwise. The landing ring 24 attaches to the sleeve member 200. The sleeve member 200 attaches to the upper portion of the load cell 208 by engaging the threads 125. The exterior load cell sleeve 222 slides over the load cell 208.

The sample head 202 attaches to the lower portion of the load cell 208 by the engaging threads 236. The aperture 203 enables mechanical engagement for clockwise and counterclockwise rotation of the sample head 202.

The sample head 202 slides into the sample tube 23. The cap screws 250 secure the sample tube 23 to the sample head 202. The aperture 251 enable mechanical engagement and rotation clockwise and counterclockwise of the cap screw 250. The cap screw threads 252 engage the sample head 202.

An o-ring seal forms a water tight seal between the sample head 202 and the sample tube 23. The o-ring seal includes an o-ring 242, an o-ring groove 244 and an o-ring backing 243. The o-ring 242 fits within the o-ring backing 243. The o-ring backing 243 fits within the o-ring groove 244.

The housing orifice 71 is used to facilitate machining of the latch-in assembly adaptor body 61.

THE DRILL STRING LANDING SUB ASSEMBLY

The drill string landing sub assembly 19 is configured to engage the landing ring 24 as the housing assembly 14 is dropped or lowered on a wire line 28 through the drill string 30. The drill string landing sub assembly 19 contains a drill string landing ring 25 to engage the landing ring 24 and halt the downward motion of the housing assembly 14 with respect to the drill string 30.

THE SAMPLE TUBE ASSEMBLY

The sample tube 23 attaches to the sample head 202 as a member of the housing assembly 14. The housing assembly 14 latches into the drill string 30 by means of latch-in assembly 34. The sample tube 23 hangs down through the bottom of the drill bit 42. The sample head 202 attaches to the load cell 208. The axial load placed on the sample tube 23 is transmitted through the sample head 202 to the load cell 208.

There are numerous other means for taking a soil sample that may be used in the present invention and the apparatus or method of the invention is not limited to the use of a cylindrical sample tube. The invention contemplates the use of any shape sampler such as a square, rectangle, triangle or any other suitable shape. The invention also contemplates the use of any means or method of extracting the soil sample, such as coring, trepanning or any other suitable method or apparatus.

THE SELECTIVELY LOCKABLE MEANS ASSEMBLY

Figure 1B:
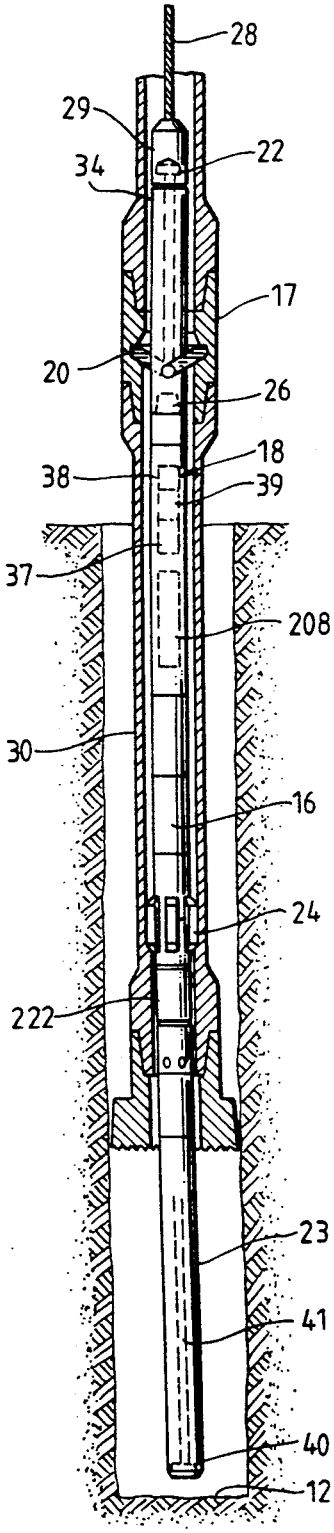
FIG. 1B is a schematic or conceptual drawing of one embodiment of the apparatus of the invention as it is lowered into the drill string and latched into place. The sampling tube extends beneath the open drill bit at the end of the drill string.
Figure 1C:
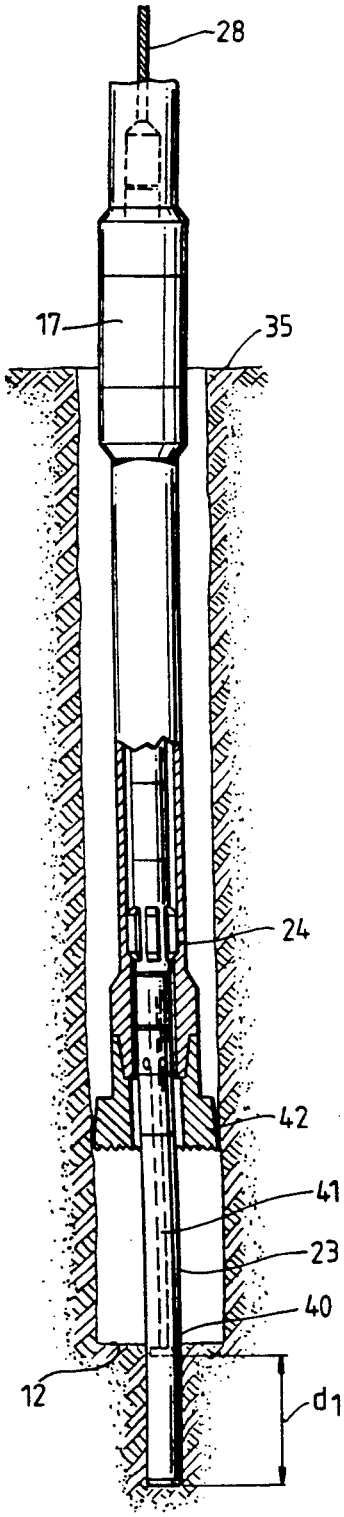
FIG. 1C is a schematic or conceptual drawing that shows a drill string pushing the sampling apparatus of the invention into the sub-sea soil bed.
Figure 1D:
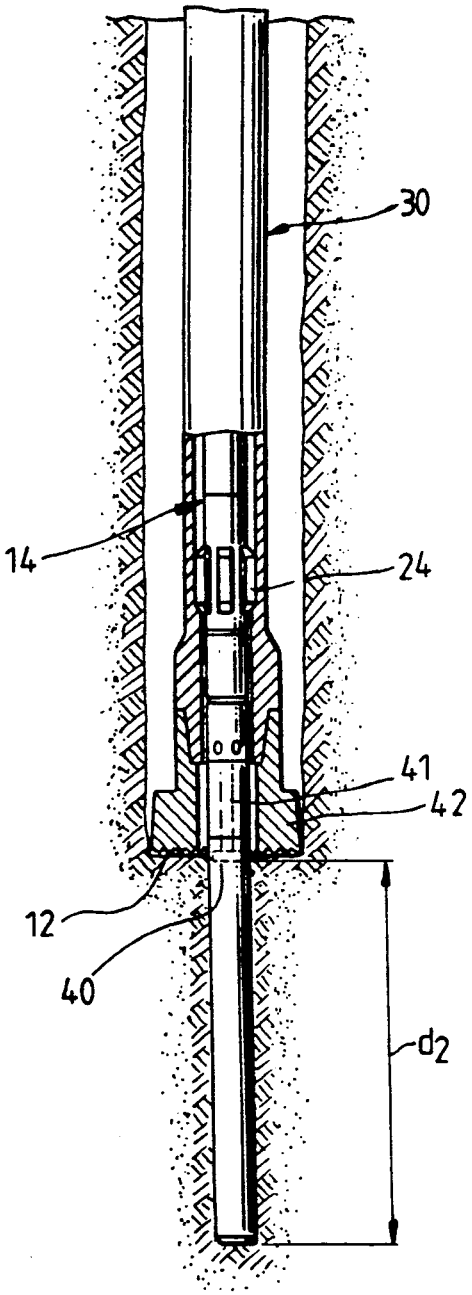
FIG. 1D is a schematic or conceptual drawing that shows the sampling apparatus of the invention after it is fully inserted into the soil bed to a depth d2.
Figure 1E:
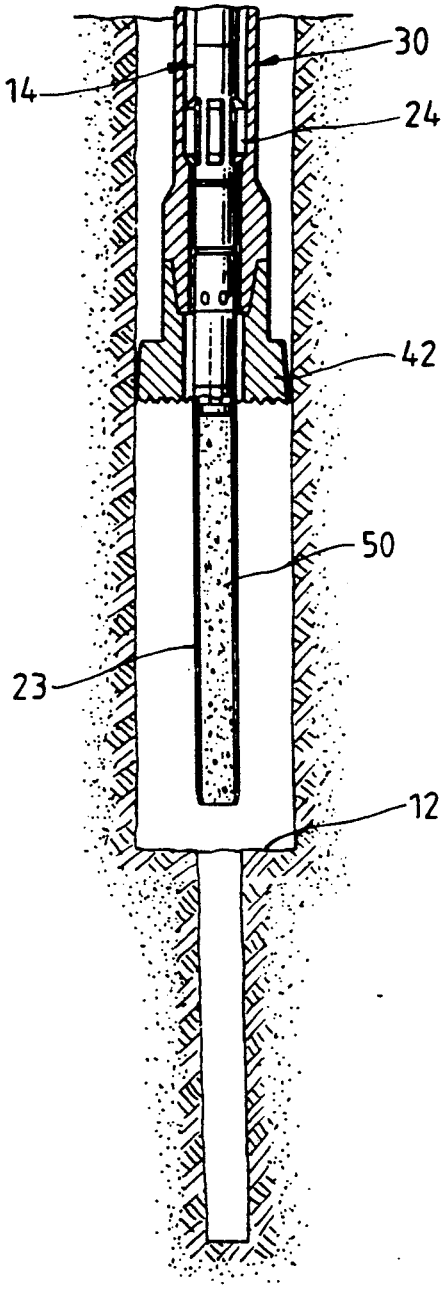
FIG. 1E is a schematic or conceptual drawing that shows the drill string as it withdraws the sampling apparatus to remove it from the soil bed.
Figure 1F:
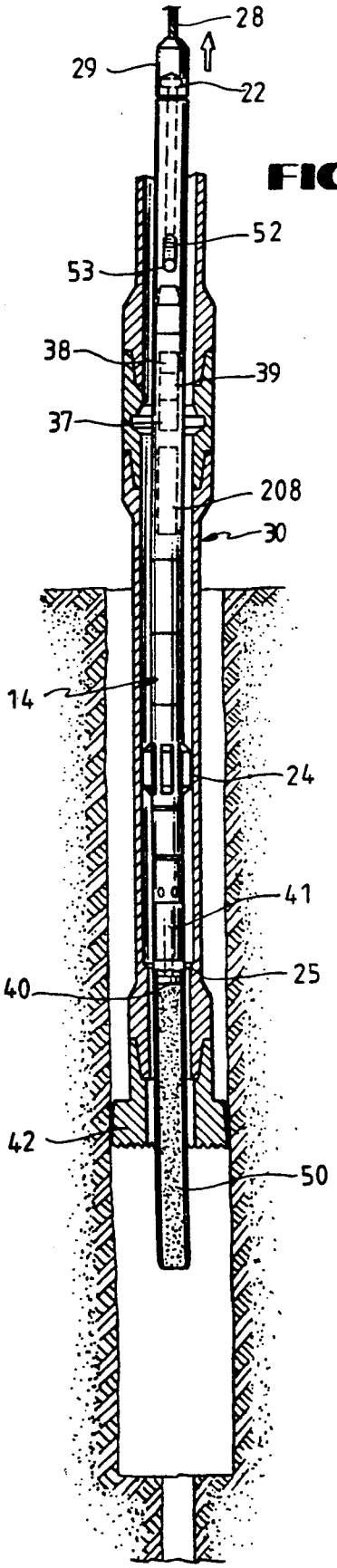
FIG. 1F is a schematic or conceptual drawing that shows the retrieval system as it attaches to the top end of the apparatus, unlatches the apparatus from the drill string and raises the apparatus to the surface.
Figure 2:
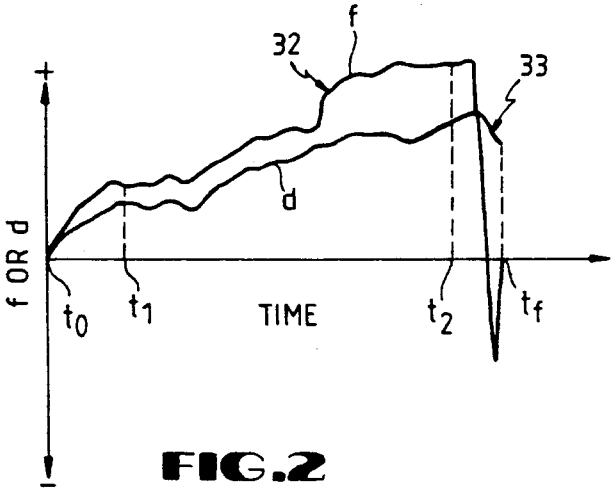
FIG. 2 is a graph that shows possible force and displacement curves, plotted as a function of time. Time t1 corresponds to depth d1 in FIG. 1C. Time t2 corresponds to depth d2 in FIG. 1D.

The selectively lockable means assembly is used to lock the housing assembly 14 into the drill string 30. In a preferred embodiment the selectively lockable means 20 is a set of latching dogs as shown in FIG. 1B that disengage the recess 15 in the drill string latching sub assembly 17 when the overshot 29 and wire line 28 engage the overshot adaptor 22 and pull upwards on the apparatus housing assembly 14. The upward motion on overshot adaptor 22 moves sliding member 53 upward in groove 52 causing the latching dogs to pivot back into the latch-in assembly, disengaging the latching dogs. Upward tension on sliding member 53 causes the latching dogs to pivot into the recesses of the latch-in assembly 34. The latching dogs are weighted so that they are normally pivoted outwardly to protrude from the exterior of the latch-in assembly 34. The selectively lockable means 20 automatically engages the drill string latching sub assembly 17 when the housing assembly 14 is lowered or dropped into place in the drill string.

THE LOAD DETECTOR ASSEMBLY

The load detector assembly is used to measure the force exerted on the sample tube 23. The load cell 208 attaches to the sample head 202 and the sample head attaches to the sample tube 23 as described in the description of the housing assembly. Retaining pin 234 passes though the exterior load cell sleeve 222, the load cell 208 and the interior load cell sleeve 228. The load exerted on the sample tube 23 is transmitted to the load cell 208. The strain gauges 210 are attached to the load cell web 206. The load cell web 206 is positioned in the load cell recess 214. The load cell wiring 92 runs from the strain gauges 210 through the load cell wiring connector 91, the feed through apertures 85, the feed through connector 84, the feed through apertures 246, the feed through apertures 87, the feed through connectors 81 and the load cell wiring passage 93 to connect the load cell to the instrument compartment interface connector 90. The protector sleeve 128 separates the load cell wiring from the piston sleeve 41.

The o-ring seals keep water out of the load detector assembly. The o-ring seals include an upper interior o-ring seal, an upper exterior o-ring seal, a lower interior o-ring seal and a lower exterior o-ring seal. The upper interior o-ring seal includes o-ring 220, an o-ring groove 221 and an o-ring backing 223. The lower interior o-ring seal includes an o-ring 218, an o-ring groove 217 and an o-ring backing 215. The upper exterior o-ring seal includes an o-ring 204, an o-ring groove 205 and an o-ring backing 209 and o-ring 216. The lower exterior o-ring seal includes an o-ring 216, an o-ring groove 213 and an o-ring backing 219.

The upper and lower exterior o-ring seals fit between the load cell 208 and the exterior load cell sleeve 222. The upper and lower interior o-ring seals fit between the load cell 208 and the interior load cell sleeve 228. The exterior load cell sleeve 222 does not abut the sleeve member 200 leaving a space 224 between the exterior load cell sleeve 222 and the sleeve member 200. The exterior load cell sleeve 222 does not abut the sample head 202 leaving a space 226 between the sleeve 222 and the sample head 202. An annular space 108 exists between the piston sleeve 41 and the LVDT 101. An annular space 127 exists between the piston sleeve 41 and the protection sleeve 128.

There are numerous other means for measuring load that may be used in the invention and the apparatus of the invention is not limited to the use of a load cell. The apparatus of the invention contemplates the use of any suitable self-contained means for measuring load.

THE MOVEMENT DETECTOR ASSEMBLY

Figure 3A:
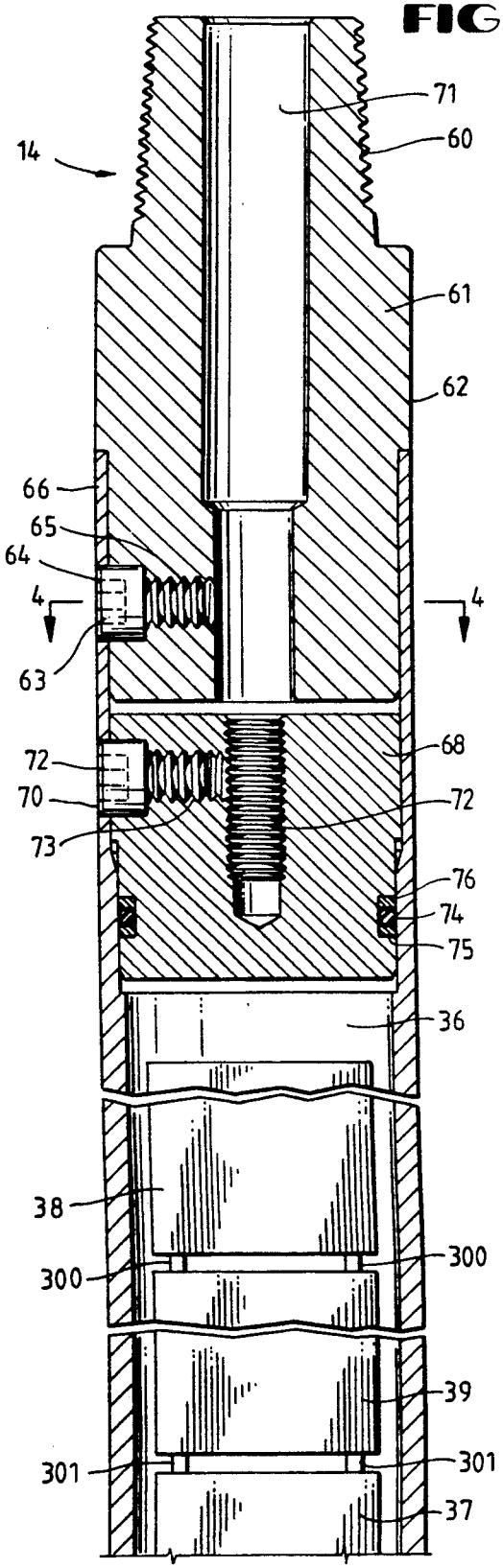
FIG. 3A is a partial longitudinal section view that shows the top section of one embodiment of the apparatus of the invention. The apparatus is divided into four sections in FIGS. 3A-3D.
Figure 3B:
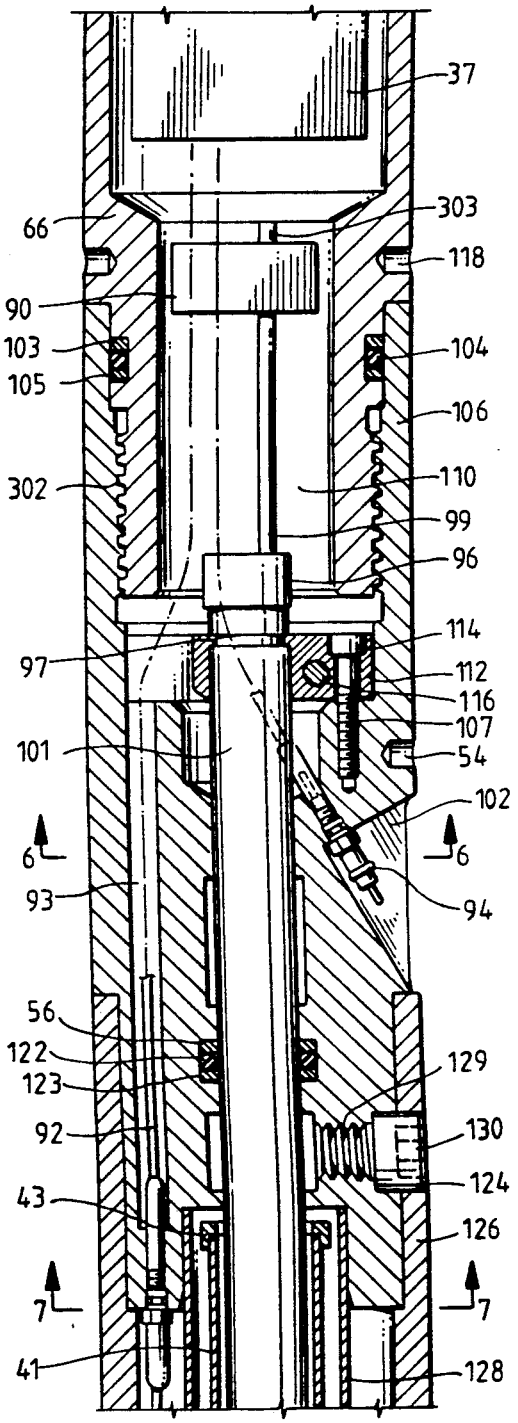
FIG. 3B is a partial longitudinal section view that shows the second section of the apparatus.
Figure 3C:
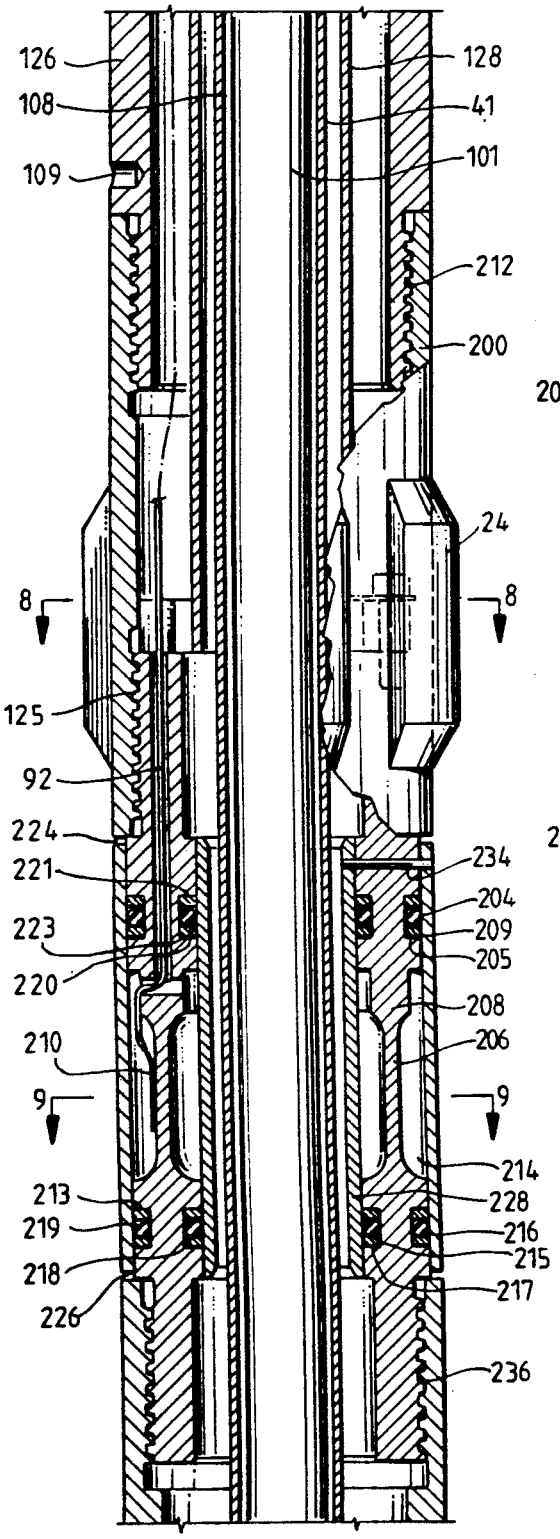
FIG. 3C is a partial longitudinal section view that shows the third section of the apparatus.
Figure 3D:
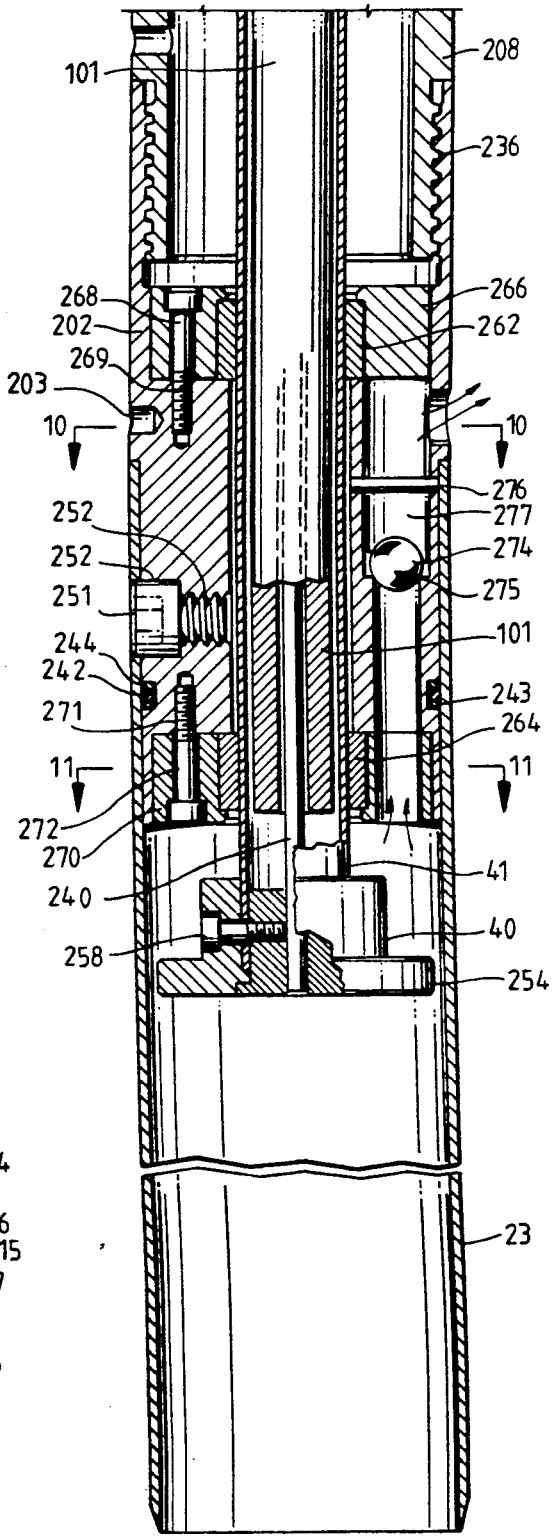
FIG. 3D is a partial longitudinal section view that shows the fourth section of the apparatus.

The movement detector assembly is utilized to measure the amount of soil sample 50 forced into the sample tube 23. The sample-follower piston 40 travels along the housing longitudinal axis and inside the sample tube 23. A piston sleeve 41 is attached to the sample-follower piston 40. The displacement of the piston head is measured by a means for measuring movement. In a preferred embodiment this means can be a linear displacement transformer LVDT 101 as shown in FIG. 3D.

There are numerous other means for measuring displacement that could be used in a preferred embodiment and the apparatus of the invention is not limited to the use of a LVDT. The apparatus of the invention contemplates the use of any self contained means for measuring displacement.

The sample follower piston 40 includes a piston face 254 and a piston hub 256. The piston sleeve or hollow piston sleeve 41 slides into the piston hub. The cap screw 258 passes through the piston sleeve 41 and into the piston hub 256 and secures the piston sleeve 41 within the piston hub 256. The LVDT core rod 240 slides into the piston hub 256 and is secured into the piston hub by cap screw 258.

As shown in FIG. 5, the LVDT 101 passes through the LVDT retaining bracket orifice 230 into the LVDT retaining bracket 112. The LVDT retaining bracket 112 engages the top portion 96 of the LVDT and clamps the LVDT 101 in place. The LVDT retaining bracket 112 slides over the LVDT 101 and abuts the top portion 96 of the LVDT. The cap screw 116 passes through the aperture 120 and engages the LVDT retaining bracket 112 to close the gap 55 and reduce the diameter of the orifice 230 and tighten the LVDT retaining bracket 112 around LVDT 101. LVDT retaining bracket 112 fits into the LVDT retaining groove 97 at the top portion 96 of the LVDT. The threads 117 engage the LVDT retaining bracket 112. The orifice 119 in the cap screw head 118 enables mechanical engagement and rotation clockwise and counterclockwise of cap screw 116.

The cap screw 114 passes through the aperture 121 in the LVDT retaining bracket 112 and secures the retaining bracket to housing member 106. The cap screw threads 107 engage the housing member 106. The aperture 113 enables mechanical engagement and rotation clockwise and counterclockwise of the cap screw 77. The LVDT wiring 92 passes through the wiring passage 110 and connects the LVDT to the instrument compartment interface connector 90.

The piston sleeve 41 slides along the longitudinal axis of the housing on piston bushings 262 and 264. The upper piston bushing 262 also serves as stop for engaging the piston stop 43. The piston stop 43 keeps the piston from falling out of the end of the housing assembly 14. The piston bushing 262 is held in place by the bushing retainer 266. The bushing retainer 266 is secured to the sample head 202 by the cap screw 268. The cap screw threads 269 engage the sample head 202 to secure the bushing retainer 266. The piston bushing 264 is held in place by the bushing retainer 270. The bushing retainer 270 is secured to the sample head 202 by cap screw 272. The cap screw threads 271 engage the sample head 202 to secure the bushing retainer 270. The piston stop 43 engages the bushing 262.

The check valve 278 allows fluid or other matter in sample tube 23 to escape through the escape valve orifice 277 as the soil sample fills the sample tube 23 and displaces any water or other matter within the sample tube 23. The reduced diameter portion of the check valve 278 forms a seat 275 for the ball 274. The check valve ball 274 moves up and away from the valve seat 275 while fluid escapes during soil capture. The retaining pin 276 prevents the ball 274 from falling out of the valve. When the housing withdraws from the soil, the ball 274 returns to a resting position and rests on the valve seat 275 and seals the escape valve orifice 277 to form a suction on and retain the soil sample 50 in the sample tube 23.

THE RECORDER ASSEMBLY

The recorder assembly is utilized to record the data measured from the load detector and movement detector and any other detector simultaneously. The data recorder assembly includes the battery pack 38, the data acquisition system 39 and the electronics package 37. The wiring 300 connects the battery pack 38 to the data acquisition system 39 and the wiring 301 connects the battery pack to the electronic package. The wiring 301 connects the electronics package 37 to the data acquisition system 39. The wiring 303 connects the instrument compartment interface connector 90 to the data acquisition system 39 and the electronics package 39.

The LVDT wiring 99 connects the LVDT to the instrument compartment interface connector 90 and thus to the recording assembly. The load cell wiring 92 connects the load cell to the instrument compartment interface connector 90 and thus to the recording assembly. The battery pack 38, the data acquisition system 39 and the electronics package are contained in the instrument compartment 36.

The external data ports 94 are mounted on the housing recess 102 to provide a means for retrieving data from the data recorder assembly. The housing recess 102 keeps the external data ports 94 recessed and protected during operations. The rubber nipple 95 slides over and protects the external data ports 94. The external data port wiring 100 connects the external data ports 94 to the data acquisition system 39 for retrieval of data.

The apparatus of the invention is not limited to the use of the specific data acquisition system described here. The apparatus of the invention contemplates the use of any self-contained means for recording data. Thus, the invention contemplates the use of optical disk storage, magnetic disk storage, and the like. The invention also contemplates the use of self-contained data acquisition systems that do not store data but transmit data to the surface without the use of a physical data cable umbilical from the surface to the apparatus of the invention.

OPERATION OF THE INVENTION

A. Apparatus Deployment and retrieval Operations

In operation, the operator drills an well bore 13 into a soil bed 35 and raises the drill bit 42 approximately 2–5 feet off the soil bed 12 at the bottom of the well bore 13. The operator either drops the housing assembly 14 down through the well bore 13 or he may lower the housing assembly 14 on a wire line 28 through the well bore without removing the drilling apparatus 30 from the well bore 13. To lower the housing assembly 14 on a wire line 28, the operator attaches a wire line 28 and overshot 29 to the overshot adaptor located on the top of the housing assembly 14 or tool.

The selectively lockable means 20, located in the latch-in assembly 34, engages the latch recess 15 in the drill string sub assembly 17 located above the drill bit 42 at the bottom of the drill pipe.

The landing ring 24 formed on the apparatus housing assembly 14 abuts the drill string landing ring 25 at the bottom of the drill string 30 during deployment to limit the downward progress of the housing assembly 14. The fluted exterior of the landing ring 24 allows fluid to pass through the flutes 45 as the housing assembly 14 moves through the drill string 30.

The operator may retrieve the housing assembly 14 by lowering an overshot 29 on the end of a wire line 28 which engages the top of the housing assembly 14. As the wire line 28 pulls up on the latch-in assembly 34, the latching dogs rotate back into the latch-in assembly 34 and disengage the recess 15 in drill string latching sub assembly 17. The wire line 28 pulls the housing assembly 14 to the surface where the user recovers the data stored by the data acquisition system 39.

In land-based operations the operator may drill a well bore 13 using drill bit 42 and then remove the drill string 30 from the well bore 13. The operator may remove the drill bit 42 and replace it with the housing 14. The housing 14 attaches to the bottom of the drill string 30. The threads 60 on the tapered member 26 engage the bottom of the drill string 30. The operator lowers the drill string 30 with the attached housing 14 down into the well bore to a position adjacent the soil bed. The drill string 30 then forces the sample tube 23 into the soil bed. The operator removes the drill string 30 to retrieve the housing 14 and the soil sample 50.

B. Load and Displacement Measurement Operations

As the drill string is lowered in the well bore, the LVDT 101 measures the displacement of the sample-follower piston 40 within the sample tube 23. The sample-follower piston 40 follows the progress of the soil sample 50 within the sample tube 23, as the drill string forces the sample tube into the soil bed. The load cell 208 measures the force exerted on the sample tube 23. The data acquisition system 39 concurrently reads and stores the force and displacement measurements as a function of time.

C. Data Capture Operations

The sample tube 23 normally penetrates the soil bed 12 at the bottom of the well bore 13 at a variable rate, enabling the determination of dynamic loading characteristics. The rate is uncontrolled in the sense that it is subject to such factors as inconsistencies in the soil bed and load fluctuations in the drill string. The tool can operate in a hostile sea state without data degradation because the data measurements are taken as a function of time. The operator retrieves the data stored by the data acquisition system 39 through the external data ports 94 after the tools returns to the surface.

The instrument compartment 36 contains the data acquisition system 39, the battery pack 38 and the electronics package 37. The instrument compartment interface connector connects the data acquisition system 39, the battery pack 38 and the electronics package 37 to the load cell 208, and LVDT 101 and external data ports 94. The instrument compartment interface connector 90 accommodates wire connections from the exterior data ports 94, the load cell 208 and from the LVDT 101.

The soil sampling and data gathering apparatus tool is totally self-contained. The tool provides its own power supply, measuring instruments and data acquisition system. A battery pack 38 provides electric power to the load cell, the LVDT, the data acquisition system and the electronics package. A plurality of o-ring seals isolate the apparatus so that it is not contaminated by the exterior environment nor does it contaminate the exterior environment.

The electronics package 37 provides an electronic interface between the data acquisition system 39 and the load cell 208, LVDT 101 and external data ports 94. The data acquisition system 39 may be comprised of an industry standard module such as the *Tattletale* Model V, available from ONSET Computer Corp., P.O Box 1030, 199 Main Street, N. Falmouth, MA 02556.

The data acquisition system typically includes a central processing unit, a universal asynchronous receiver/transmitter, an analog to digital converter, static RAM and EPROM. The data acquisition system takes analog signals from the load cell and LVDT and converts them to digital signals. The data acquisition system samples the analog signals from the load cell and LVDT at regular intervals, as for example every 10 milliseconds, converts these analog measurements into digital signals and stores the digital signals. The resulting data measurements represent a force curve 32 and displacement curve 33 as a function of time during the sampling session.

The invention is not limited to any particular conventional data acquisition system. The invention contemplates any suitable data sampling and storage device, such as optical disc or any other means of data storage. There are numerous uses for the recovered measurement data. It is contemplated that additional uses and interpretations will develop as the users of the invention gain experience with the apparatus and method and the data derived from its use.

D. Soil Capture Operation

The sampling tube 23 typically hangs down about 2 feet beyond the bottom of the drill bit 42. The operator allows the drill string 30 to descend at an uncontrolled rate which presses the sample tube 23 into the soil bed at a variable rate. The pressure from the drill string forces a soil sample 50 into the sample tube 23 as the sample tube 23 penetrates the soil bed 12 at the bottom of the well bore 13. The sample-follower piston 40 tracks the progress of the soil sample 50 as it enters the sampling tube 23. The check valve 278 allows fluid to escape from the sampling tube 23 as the soil sample 50 displace fluid in the sample tube 23. When the sample tube 23 Withdraws from the soil bed 12, the check valve ball 274 seats and seals to provide suction that holds the soil sample 50 in the sample tube 23.

The apparatus captures a soil sample 50 in the sampling tube 23, and gathers data on the soil bed 12, in situ, concurrently. The uncontrolled descent of the drill string 30 forces the sampling tube 23 into the soil at a variable penetration rate, enabling the user to determine the dynamic and static loading characteristics of the soil bed. The time measurements also facilitate data corrections for variable loading.

E. Load Measurement Operations

The load cell 208 measures the force exerted on the sample tube 23. The force on the sample tube 23 is transmitted from the sample tube 23 through the sample head 202 to the load cell 208. The top of the load cell 208 screws into the sleeve member 200 and the bottom of the load cell 208 screws into sample head 202.

The load cell wiring 92 from the load cell 208 connects to the load cell wiring connector 91 and passes upwardly through the load cell wiring passage 93 and connects to the instrument compartment interface connector 90. The data acquisition system 39 records the load measured by the load cell as a function of time.

A plurality of strain gauges 210 attach to the load cell web 206 to determine the load as a average of the measurements taken at the strain gauges. The load cell wiring 92 runs from the strain gauges 210 up through the load cell wiring passage 93. The load cell wiring passage 93 is sealed to keep water and other contaminants. The load cell web 206 is positioned between the interior load cell sleeve 228 and the exterior load cell sleeve 222. The load cell is sealed by a series of upper and lower load cell o-rings 204, 220, 216 and 218 placed between the load cell and the interior and exterior load cell sleeves. The exterior load cell sleeve 222 protects the load cell from the environment.

The outer load cell sleeve is separated from the sleeve member 200 by a space 224 and a space 226 so that the axial load passes through the load cell instead of sleeve member 200.

F. Displacement Measurement Operations

The sample-follower piston 40 hangs down inside the sample tube 23. The sample-follower piston 40 follows the soil sample 50 into the sampling tube 23 as the drill string 30 pushes the sampling tube 23 into the soil bed 12. The LVDT core rod 240 attaches to the soil follower piston hub 256 by means of cap screw 259. The LVDT 101 measures the progress of the soil sample 50, as it moves into the sample tube 23 displacing the sample-follower piston 40 and attached LVDT core rod 240. The LVDT core rod 240 moves within the LVDT 101 and generates an electrical signal proportional to the displacement of the LVDT core rod 240 and sample-follower piston 40. The cap screw 258 allows for adjustment of the sample-follower piston 40 position relative to the LVDT core rod 240 to fix the piston face 254 on the LVDT core rod 240 at the calibrated null position of the LVDT 101.

The LVDT 101 remains environmentally isolated and water tight even at extreme water pressure through the use of the LVDT o-ring. LVDT retaining screw 114 secures the LVDT retaining bracket 112 to housing member 106.

The piston sleeve 41 slides on replaceable bushings 262 and 264. The bushings keep the piston sleeve aligned along the longitudinal axis of the apparatus without rubbing against the LVDT. The piston sleeve annular stop 43 abuts the upper piston sleeve bushing 262 and halts the downward motion of the sample follower piston 40.

SUMMARY OF ADVANTAGES

It will be appreciated that the method and apparatus for determining the dynamic characteristics of a soil bed by penetrating a soil bed at a variable penetration rate and measuring the force and displacement of the sampling device as a function of time of the present invention, provide certain significant advantages.

The present invention is self-contained and environmentally sealed. The apparatus is capable of operating on land or at great depths under the sea. The apparatus is simple and easy to build, with fewer parts than known systems. The apparatus reduces or eliminates the need for a physical data and control umbilical to the surface. The method can be performed on land or in a benign or hostile sea state without the need for motion compensation. The method may also be performed more quickly than known methods. The concurrent acquisition of a core or soil sample as well as load data and penetration data provides a valuable insight into the characteristics of a soil bed and its pile carrying capacity.

We claim:

1. Apparatus for sampling a soil bed at the bottom of a bore hole, comprising:

a housing adapted to be attached to the bottom of a drill string and lowered to a location adjacent the soil bed;

a sample tube extending below the housing for penetrating the soil be;

a load detector within the housing adapted to generate a first signal corresponding to forces on the sample tube as a function of time;

a movement detector within the housing adapted to generate a second signal corresponding to the upward displacement of a soil sample within the sample tube as a function of time; and a recorder within the housing adapted to record the first and second signals concurrently.

2. The apparatus of claim 1 in which the sample tube is a right circular cylinder for retaining a sample of the soil bed which enters the sample tube during such penetration.

3. The apparatus of claim 1 in which the load detector comprises a load cell.

4. The apparatus of claim 1 in which the forces measured by the load detector include compression forces.

5. The apparatus of claim 1 which said movement detector is a linear displacement transducer.

6. The apparatus of claim 5 in which said linear displacement transducer comprises a piston within a right circular cylinder that follows the soil sample up into the cylinder during penetration.

7. The apparatus of claim 1 in which the forces measured by the load detector include tension forces.

8. A soil-sampling method, comprising the steps of:

attaching to the bottom of a drilling string a sampling device having a sample tube and a recording system for recording one or more parameters measured in connection with collection of a soil sample;

lowering the drilling string into a well;

penetrating soil located at a bottom of the well sufficiently to collect a soil sample with the sample tube;

measuring real time displacement of the soil sample within the sample tube and real-time force experience by the sample tube;

removing the drilling string and the sampling device from the well; and retrieving the soil sample from the sampling device.

9. The method of claim 8 wherein said force comprises real-time compression force experienced by the sample tube.

10. The method of claim 8 wherein said force comprises real-time tension force experienced by the sample tube.

* * * * *